US009486021B2

(12) United States Patent
Keil et al.

(10) Patent No.: US 9,486,021 B2
(45) Date of Patent: Nov. 8, 2016

(54) GLOVE

(75) Inventors: Michael Keil, Mücke-Merlau (DE); Alexander Kreisz, Steindorf Stadt Wetzlar (DE); Jörg Zell, Gross-Rohrheim (DE)

(73) Assignee: JUNG GUMMITECHNIK GMBH, Einhausen (DE)

( * ) Notice: Subject to any disclaimer, the term of this patent is extended or adjusted under 35 U.S.C. 154(b) by 867 days.

(21) Appl. No.: 13/809,129

(22) PCT Filed: Jul. 7, 2011

(86) PCT No.: PCT/DE2011/001433

§ 371 (c)(1),
(2), (4) Date: Jan. 8, 2013

(87) PCT Pub. No.: WO2012/003826

PCT Pub. Date: Jan. 12, 2012

(65) Prior Publication Data

US 2013/0111647 A1 May 9, 2013

(30) Foreign Application Priority Data

Jul. 9, 2010 (DE) ..... 10 2010 031 204

(51) Int. Cl.

| | |
|---|---|
| ***A41D 19/01*** | (2006.01) |
| ***A41D 19/015*** | (2006.01) |
| ***A41D 19/00*** | (2006.01) |
| ***A41D 19/04*** | (2006.01) |

(52) U.S. Cl.

CPC ..... *A41D 19/015* (2013.01); *A41D 19/0027* (2013.01); *A41D 19/0055* (2013.01); *A41D 19/04* (2013.01)

(58) Field of Classification Search

CPC ..... A41D 19/00; A41D 19/0024; A41D 19/0055; A41D 19/015

See application file for complete search history.

(56) References Cited

U.S. PATENT DOCUMENTS

| | | | | |
|---|---|---|---|---|
| 3,025,403 | A | 3/1962 | Belknap et al. | |
| 4,061,709 | A | 12/1977 | Miller et al. | |
| 2005/0150788 | A1* | 7/2005 | Feusner | B65D 85/18 206/278 |
| 2007/0008152 | A1* | 1/2007 | Parias | F17C 13/003 340/573.1 |
| 2009/0156309 | A1 | 6/2009 | Weston et al. | |
| 2012/0227158 | A1* | 9/2012 | Ashworth | A41D 19/015 2/164 |

FOREIGN PATENT DOCUMENTS

| | | |
|---|---|---|
| DE | 10 2008 005 986 | 7/2009 |
| EP | 1 637 046 | 3/2006 |

(Continued)

OTHER PUBLICATIONS

German Patent and Trademark Office, "Examination Report," issued in connection with German Application No. 10 2010 031 204.5-26, dated Apr. 7, 2011, (3 pages).

(Continued)

*Primary Examiner* — Shaun R Hurley
*Assistant Examiner* — Andrew W Sutton
(74) *Attorney, Agent, or Firm* — Hanley, Flight and Zimmerman, LLC

(57) ABSTRACT

A disclosed example glove of a glovebox type includes an identification means arranged at an end portion of a cuff of the glove.

17 Claims, 3 Drawing Sheets

(56) References Cited

FOREIGN PATENT DOCUMENTS

| | | |
|---|---|---|
| GB | 2460430 | 12/2009 |
| JP | 2002352200 | 12/2002 |

OTHER PUBLICATIONS

Patent Cooperation Treaty, "Written Opinion," issued by the International Searching Authority in connection with PCT application No. PCT/DE2011/001433, mailed Dec. 23, 2011 (9 pages).

Patent Cooperation Treaty, "International Preliminary Report on Patentability," issued by the International Searching Authority in connection with PCT application No. PCT/DE2011/001433, mailed Jan. 15, 2013 (11 pages).

Patent Cooperation Treaty, "International Search Report," issued by the International Searching Authority in connection with PCT application No. PCT/DE2011/001433, mailed Dec. 23, 2011 (4 pages).

German Patent and Trademark Office, "Translation of Office Action," issued in connection with German Application No. 10 2010 031 204.5-26, dated Apr. 7, 2011, (4 pages).

* cited by examiner

GLOVE

RELATED APPLICATIONS

This is a US National Stage Application under 35 USC 371 of International Patent Application No. PCT/DE2011/001433, filed on Jul. 7, 2011, which claims priority to German Patent application no. 10 2010 031 204.5, filed on Jul. 9, 2010, all of which are hereby incorporated herein by reference in their entireties.

FIELD OF THE DISCLOSURE

The present disclosure relates generally to gloves and methods for manufacturing the same.

BACKGROUND

Gauntlets provide for protection of users, e.g., against chemicals or infections, on the one hand, and ensure hygienic and aseptic working conditions, e.g., in the pharmaceutical industry, on the other hand. Especially, multi-usable gauntlets, for example for a glovebox, have to be regularly cleaned and sterilized, respectively, during their lifetime and usage time in order to prevent contaminations and non-aseptic working conditions. For this purpose, vapor and aggressive chemicals as, e.g., hydrogen peroxide, are often used. Further, the gloves must be regularly inspected for, for example, defects, with respect to their protection effect.

BRIEF DESCRIPTION OF THE DRAWINGS

The following disclosure is described by way of examples and with reference to the attached drawings, in which.

DETAILED DESCRIPTION

Figure 1:
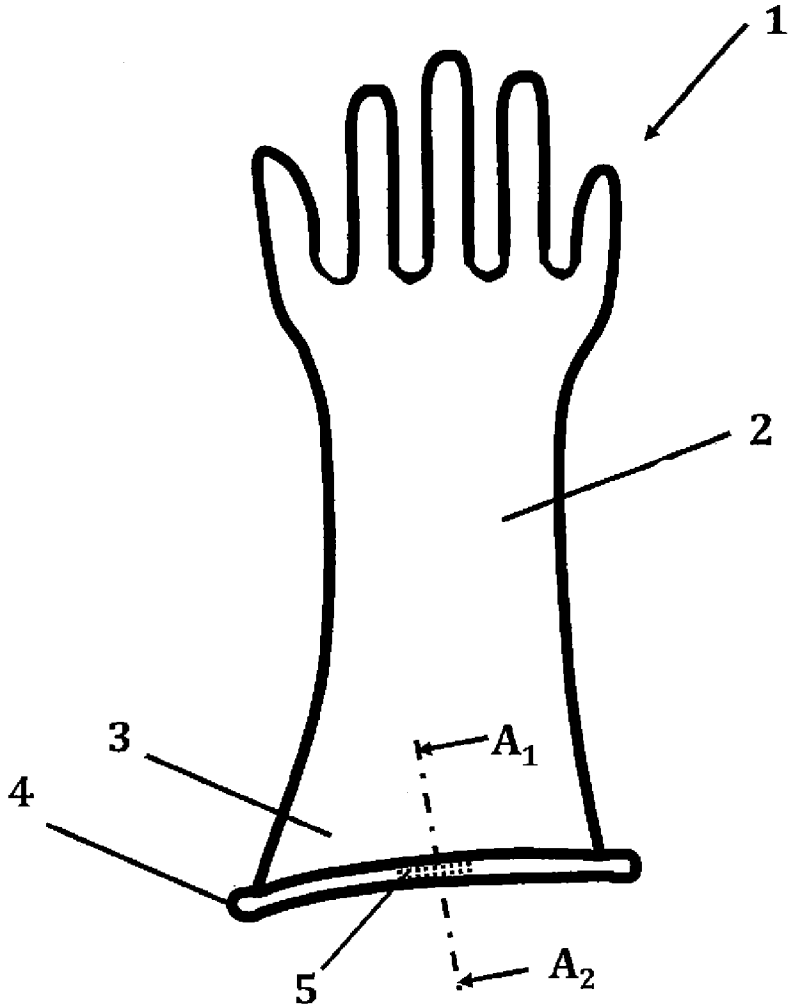
FIG. 1 is a view of a disclosed example glove.

In the following, disclosed examples are described in detail with reference to the attached Figures. However, the scope of coverage of this patent is not limited to the examples disclosed herein. To the contrary, this patent covers all methods, apparatus, systems, and articles of manufacture fairly falling within the scope of the appended claims either literally or under the doctrine of equivalents. In the Figures, same or similar features of the disclosed examples are denoted by the same reference numerals.

Disclosed example gloves are, for example, of the glovebox type which are provided with an identification means, for example a radio frequency identification (RFID) chip. Example gloves disclosed herein enable improving hygiene and security conditions and enable simplifying compliance with their standards by the users, respectively.

Due to regular inspection and cleaning/sterilization, respectively, current glove identification by means of marking becomes unrecognizable in the course of time. This prevents a safe identification of the glove and a gapless traceability over its whole usage and service life (life-cycle). However, this is extremely important in application areas which are critical with respect to hygiene and security.

Glovebox gloves must meet very high requirements because they are often used to handle, among others, very toxic, corrosive or easily contaminable substances.

One example of endangering security would be, e.g., that a user of a glove, if the marking is unrecognizable, erroneously uses the glove in working with substances and chemicals, respectively, for which the material of the glove is not suitable and therefore might not offer protection.

Further, it would, for example, endanger hygiene and security, if the user did not strictly comply with intervals for sterilization and cleaning, respectively, or the inspection of the glove so that samples are contaminated from being in contact with the glove or a defect of the glove cannot be recognized in time.

Disclosed examples provide a glove which enhances the security of the user of the glove and improves hygiene conditions.

A disclosed example glove provides an identification means at an end portion of a cuff of the glove.

In disclosed examples, a glove, e.g., a glovebox glove, is equipped with an identification means, e.g., a radio frequency identification chip (RFID chip), such that data can be communicated wirelessly with at least one of a receiving unit or a reading unit or a transmitting unit (transceiver unit). This transceiver unit can in turn communicate with a base station, e.g., wirelessly. The transceiver unit can, for example, be arranged close to the identification means. This data can produce a life cycle of each glove during the whole service life so that inspection data, inspection intervals, cleaning and sterilization intervals, the number of inspections and sterilizations, respectively, substances handled with this glove and/or the age of the glove can be determined at all times. Therefore, the labeling and the traceability of the life cycle of the glove are significantly improved.

Further, hygiene conditions can be enhanced by providing, e.g., alert devices which automatically alert the user if the transceiver unit, when reading out the identification means, determines that for example a sterilization has been forgotten and is necessary, respectively, or that the wrong glove has been chosen for the substances to be processed.

In a disclosed example arrangement providing for the identification means at an end portion of a glove, the identification means is located outside a glovebox when working with the glove in a glovebox. Therefore, the transceiver unit which is fixed outside of the glovebox can communicate data with the identification means over the shortest transmission path. Here, the identification means, for example, the RFID chip, can be embedded, for example, into a substance matrix.

Among others, there are therefore significantly better or increased assurances that always only one glove is identified by the transceiver unit and, thus, no confusion can occur with gloves in adjacent gloveboxes that could critically decrease security of the glove. Further, the required transmission power of the transceiver unit may be kept very low because the transceiver unit may, for example, be arranged very close to the identification means, e.g., a few centimeters (inches), e.g., 3-10 cm (1.181-3.937 inches).

Further, using an example arrangement according to disclosed examples of the identification means, a user of a glove is protected against injuries, and the glove is damaged at a location not critical for the security, respectively, if, for example, an accidental destruction of the identification means occurs, especially if a glass-based RFID chip bursts. This further advantageously enhances the security properties of the glove.

Further, in some disclosed examples, a glove may be provided with a welt, wherein the welt may be a rolled up section of an end portion of the glove. The identification means can be fixedly secured to the welt.

A disclosed example connecting operation of the identification means to the welt is especially advantageous because the identification means at this location of the glove does not interfere with the user performing his work, and the welt is arranged outside of the glovebox when the glove is provided for a glovebox.

Further, the identification means can be fixedly arranged in a cavity of the welt formed between welt turns.

When the welt is manufactured by rolling up a part of the end portion, a cavity can be formed which either can extend over the whole circumference of the welt or may be merely dimensioned such that the space is just sufficient to place the identification means therein. The arrangement according to disclosed examples of the identification means within the welt protects the identification means as far as possible, for example, against substances handled with the glove, because the welt forms a hermetically sealed protective cover/encapsulation around the identification means. Further, the identification means within the welt is securely connected to the glove without any additional fixing means.

Further, the identification means may be connected to the glove in such a way that the identification means may be arranged in the welt before a vulcanization process is performed, and the glove may be vulcanized with the identification means.

By embedding and inserting and applying, respectively, the identification means before the vulcanization, the glove may be relatively easily manufactured without additional cost.

Further, the identification means may be fixedly connectable with the glove by vulcanization.

In some examples, the welt is connected and welded, respectively, by vulcanization such that the identification means is permanently and fixedly held within the welt. This effectively prevents any manipulation of the identification means because this is no longer possible without destruction of the glove.

Additionally, the glove may have a multilayer structure. The identification means may be arranged between two layers at an end portion, and the layers of the glove may be fixedly connectable with each other by vulcanization. The identification means may be fixedly held within the end portion.

Based on this arrangement according to disclosed examples in which a welt may optionally be provided on the glove, the identification means is securely and fixedly held at the end portion, and an encapsulation of the identification means is substantially guaranteed so that a high degree of security in operation is achieved.

Additionally, the glove together with the identification means which may be arranged at the end portion and/or at the welt may be mounted to a clamping fixture of a glovebox by means of the welt and/or the end portion.

The arrangement according to disclosed examples of the identification means at the glove allows for the clamping of the glove on the clamping fixture of a glovebox without damaging the identification means. In some examples, this achieves a substantially optimum short radio transmission path to the transceiver unit, for example, outside of the glovebox.

In an example method according to disclosed examples for manufacturing an example disclosed glove, the identification means may be arranged at an end portion of a non-vulcanized glove. The identification means may be embedded into the welt and/or between layers of the glove. After arranging the identification means on the glove, vulcanization may be performed.

An example manufacturing method according to disclosed examples offers the advantage that the glove may be manufactured with low costs and that the identification means may be securely, fixedly and hermetically encapsulated into the glove without additional costs.

Disclosed examples have one or more advantages, including that disclosed example gloves enhance the security of users. Further, hygiene conditions may be significantly improved, because the life cycle of the glove may be gaplessly tracked back at all times and the data may be wirelessly transmitted to the identification means and/or may be read out therefrom. This, for example, enables inspection intervals or the sterilization intervals to be displayed to the user of the glove, whereby especially contamination of samples by any gloves which were cleaned or sterilized too seldomly may be prevented. In addition, protection, as best as possible, against infections, contaminations and chemicals may be offered to the user and the product, respectively.

FIG. 1 shows an example glove 1 which may be a security glove, for example, for a glovebox.

The glove 1 may be formed in such a way that it may be worn on either the left hand or the right hand. It may also be embodied fully anatomical, and then may be suitable for use by right-handers or left-handers. Here, the glove 1 may be embodied in any size, for example, in all standard sizes from XXS (extra extra small) to XXL (extra extra large). The length of the glove 1 may preferably, but not necessarily, be in the range from 600 mm (23.622 inches) to 1000 mm (39.370 inches). However, the length of the glove 1 may deviate from the preferred length, for example, 220 mm (8.661 inches) or 1200 mm (47.244 inches).

The glove 1 may preferably, but not necessarily, be manufactured using a vulcanizable polymer, e.g., chlorosulfonated polyethylene (CSM), ethylene-propylene-dien-rubber or butyl-rubber. Further, the glove 1 may also be provided with a coating, e.g., a glove 1 manufactured from bromobutyl with coating from CSM. The material thickness of the glove 1 may be in the range from 0.01 mm (0.00039 inches) to 2 mm (0.078 inches), and preferably, but not necessarily, between 0.4-0.8 mm (0.015-0.031 inches).

Thus, the glove 1 of the illustrated example meets or exceeds the highest security and quality standards, for example, the glove 1 presents a high gas tightness, a low swelling for a plurality of polar media and an excellent resistiveness against ozone, oxygen and/or weather. Further, the glove 1 is heat-resistant and cold-resistant as well as electrically insulating to a relatively high degree (e.g., in the highest degree).

Therefore, the glove 1 is suitable for a broad application spectrum, e.g., for the application to the handling of alkaline earthy iodides which are used in the manufacturing of lithium-based battery cells, in the development and manufacturing of sodium sulfur cells, in sodium analyses and in the processing of plutonium in the nuclear technology, in the inspection of organometallic compounds, in the preparation of crystals for transmission and incident light microscopy, in operating special welding technologies and/or in performing works in sterile rooms.

FIG. 1 further shows that the glove 1 has a cuff which is a portion of the glove 1 which extends with different lengths from the wrist towards the shoulder of the user of the glove 1. The length of the cuff 2 may be in the range, for example, from 50 mm (1.968 inches) to 1000 mm (39.370 inches).

An outer portion towards the opening of the glove of the cuff 2 is an end portion 3 of the glove 1. This end portion 3 is rolled up at its outer end. This rolled up portion is a welt 4. The thickness of the welt 4, i.e., the diameter of the welt 4, may be in the range from 1 mm (0.039 inches) to 15 mm (0.590), and preferably, but not necessarily, 2-6 mm (0.078-0.236 inches).

In some examples, when clamping the glove 1 to a glovebox having a clamping fixture, substantially the end portion 3 and the welt 4 are mounted to the clamping fixture of the glovebox. In some examples, the clamping fixture (glove fixture) of a common glovebox has a length of 30-100 mm (1.181-3.937 inches) and is shaped circular cylindrical or oval cylindrical. The glove 1 of the illustrated example is fixed by clamping the end portion 3 together with the welt over the clamping fixture. In this manner, the welt 4 is guided in a groove which is arranged at the outer generated surface of the clamping fixture perpendicular to its longitudinal axis around the circumference. After clamping of the glove 1, the welt 4 does not protrude over the groove so that the diameter of the welt 4 is received with its whole circumference in the groove. Therefore, attachment means, for example, clamps which are secured to the fixture over the mounted glove, do not squeeze the welt 4.

The portion of the welt 4 presenting an identification means 5 is transparently shown in FIG. 1 so that the identification means 5 which is embedded into the welt 4 is shown in dotted lines.

Preferably, but not necessarily, the identification means 5 is a RFID chip (radio frequency identification chip) in the illustrated example. However, the identification means 5 may also be another transponder which is suitable for wirelessly transmitting and/or receiving and/or storing data. The RFID chip may be active or passive and preferably, but not necessarily, presents an internal storage so that life-cycle data of the glove 1 may be stored in the identification means 5. The life-cycle data comprise, among others, e.g., inspection data, inspection times, inspection intervals, cleaning and/or sterilization times and/or intervals and/or the age of the glove 1. Further, in the identification means 5, additional data may be stored, for example, material data and security data of the glove 1, a charge number, an article number and/or user data of the owner of the glove. Further, for example, manufacturer data and other data, respectively, which need special security against manipulation may be stored in non-erasable and/or non-overwritable storage of the RFID chip.

The identification means 5 of the illustrated example of FIG. 1 has the shape of a cylindrical bar. However, a different identification means 5, for example with a different shape, e.g., a plate-shaped means, may be provided. The substance matrix of the identification means 5 preferably, but not necessarily, is implemented using glass. However, it may also be implemented using synthetic material or of a different material.

The identification means 5 is attached within the welt 4 of the glove 1, because the latter is arranged outside of the glovebox, if the glove is clamped onto the glove fixture. Thus, a transceiver unit communicating wirelessly with the identification means 5 may be mounted close to the clamping fixture outside of the glovebox. In this manner, a short radio transmission path, for example, a few centimeters, resulting in good transmission quality is substantially guaranteed between the identification means 5 and the transceiver unit using a relatively low transmission power of the respective transceiver unit. Thus, in many gloveboxes and/or engagements in gloveboxes which are arranged very close to each other, erroneous identifications are prevented, when one or more transceiver units simultaneously have detected a plurality of gloves 1.

Further, during an inspection of the glove 1, the transceiver unit may also be mounted in and on an inspection disc, respectively, onto which the glove 1 may be clamped. Thus, also during such an inspection, disclosed examples enable providing a short radio transmission path between the transceiver unit and the identification means 5.

Figure 2:
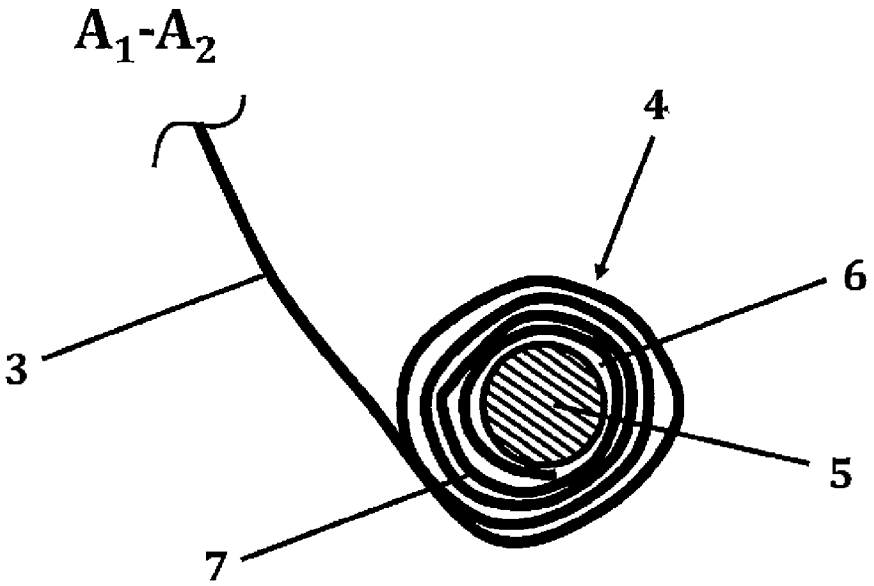
FIG. 2 is a sectional view of a welt together with an identification means along a section line $A_1$-$A_2$ before a vulcanization of the example glove is performed.

FIG. 2 shows the identification means 5 may be embedded into the welt 4 before the glove has been vulcanized. In the illustrated example, the identification means 5 is substantially centered within a cavity 6 which results from rolling up a section of the end portion 3. The number of welt turns 7 depends on the desired diameter of the welt and on the material thickness of the glove 1. Preferably, but not necessarily, the cavity 6 is just sufficiently large enough to enable the identification means 5 to be closely fitted therein. However, a circumferential cavity 6 around the welt may also be used.

Figure 3:
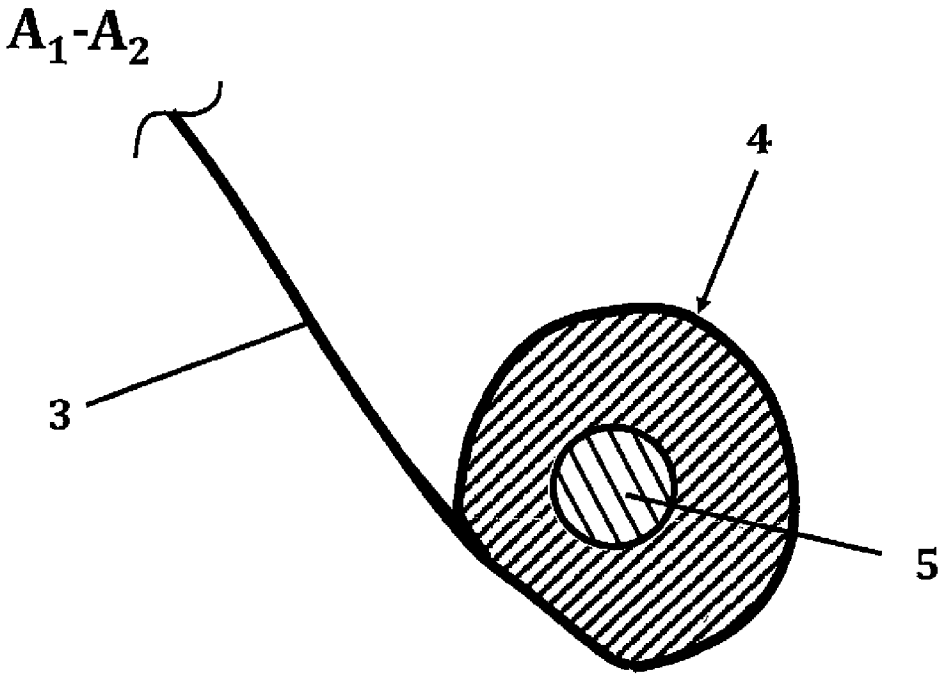
FIG. 3 is a sectional view of the welt together with the identification means along the section line $A_1$-$A_2$ after the vulcanization of the glove has been performed.

FIG. 3 shows the welt 4 after vulcanization. The welt 4 is permanently and fixedly welded to the end portion 3 and secured against unrolling, because the vulcanization of the glove 1 is not performed until the welt 4 is manufactured. By vulcanizing the glove 1 after establishing the welt 4 in which the identification means 5 is rolled up, the identification means 5 is securely and permanently fixedly held in the welt 4. The welt turns 7 are melted together after vulcanization.

In the case in which non-vulcanizable materials are employed for the manufacturing of the glove 1, the welt 4 including the identification means 5 therein could also be permanently fixed by adhesion or thermal processes.

The glove 1 of the illustrated example is preferably, but not necessarily, manufactured by immersing into a rubber solution. In the illustrated example, the rubber solution consists of the polymer forming the glove material and of suitable solutions. In a first step, an immersion mould, e.g., from aluminium, porcelain or synthetic material specifying the form of the glove is immersed into the liquid rubber solution. In drawing out the immersion mould, the rubber solution adheres to the immersion mould. After this immersing step, the immersion mould with the rubber solution applied thereon is dried, for example for 5 minutes to 72 hours, and preferably, but not necessarily, 1 hour to 5 hours.

After drying the rubber solution on the immersion mould, the welt 4 is manufactured by manually rolling up a section of the end portion 3. In some examples, a mechanical manufacture may also be used. The welt thickness is checked, for example, by means of a caliper rule or it is mechanically measured and controlled. In the illustrated example, simultaneously with the manufacturing of the welt 4, the identification means 5 is rolled into the welt 4. Thereby, no air bubbles or irregularities should occur which could affect the function of the glove 4 and the welt 4, respectively.

If the glove 1 consists of a plurality of material layers, the identification means 5 may also be embedded between two layers at the end portion 3. This allows, e.g., a secure encapsulation of the identification means 5 even if, for example, no welt 4 is manufactured. In some examples, the identification means 5 may also be embedded between two layers in the section of the end portion 3 which then, after the identification means 5 is embedded, is rolled up into the welt 4.

After the manufacturing of the welt 4, the whole glove 1 is vulcanized, whereby the glove material becomes elastic and the welt is securely embedding the identification means 5 (see FIG. 3).

The vulcanization constraints depend on the glove material and on the maximum stress limit of the identification means 5, which should not be damaged during vulcanization. Therefore, the vulcanization may be performed at a pressure in the autoclave from 1 bar to 10 bar and at a temperature from 120° C. (248° F.) to 200° C. (392° F.) from 10 min to 6 hours. In some examples, a pressure from 4 bar to 5 bar, a temperature from 140° C. (284° F.) to 170° C. (338° F.) and a time period from 1 hour to 3 hours are preferred. Preferably, but not necessarily, the vulcanization is performed in an oxygen reduced atmosphere.

After the vulcanization, the completed glove 1 is stripped off the immersion mould.

Further, the glove 1 allows the establishment of the life-cycle by storing all inspection results of the glove 1 during its usage period via the base station and the transceiver unit, respectively, in the identification means 5. Here, the base station wirelessly transmits the inspection data via the transceiver unit to the identification means 5 after each inspection, and instructions to store the data in the identification means 5. In this manner also the data about the number of sterilizations or cleanings of the glove 1 may be transmitted and stored. The data may be wirelessly read out at any time from the transceiver unit at a later point of time and, thus, reproduce a precise life cycle of the glove 1. Further, also user data may be stored in the identification means 5 in order to uniquely associate the user or any security data, for example, with the substances for which the glove 1 is applicable. The transceiver unit which is, for example, arranged close to the clamping fixture outside of the glovebox, can then, for example, alert that a wrong glove 1 is used for the working substances or that a user is not wearing his own glove 1 or that a sterilization or an inspection has to be performed.

Examples disclosed herein have advantages including that the glove 1 enhances the security of the user and of the product, and improves the hygiene conditions, because unique identification of the glove 1 is enabled during its whole usage period so that, for example, before the handling of substances with inappropriate gloves 1, an automatic alert is initiated or the compliance with inspection and cleaning intervals is automatically supervised and remembered at all times. Data measured during inspection may be permanently stored in the identification means 5 and is available at all times. In working in a glovebox, the identification means 5 is advantageously located outside of the glovebox so that a radio transmission path to the transceiver unit is relatively short and substantially free of disturbances. In some examples, the short radial transmission path prevents that all of a plurality of gloves 1 in the proximity of a transceiver unit are simultaneously or erroneously detected by the transceiver unit. The welt 4 is mountable to a clamping fixture of a glovebox in such a manner that the identification means 5 is not damaged, for example, by receiving the welt 4 completely in a groove of the clamping fixture.

Although certain methods, apparatus, systems, and articles of manufacture have been disclosed herein, the scope of coverage of this patent is not limited thereto. To the contrary, this patent covers all methods, apparatus, systems, and articles of manufacture fairly falling within the scope of the claims either literally or under the doctrine of equivalents.

1 glove
2 cuff
3 end portion
4 welt
5 identification means
6 cavity
7 welt turns

The invention claimed is:

1. A glove of a glovebox type, the glove comprising:

an identification means arranged at an end portion of a cuff of the glove, the identification means being a radio frequency identification (RFID) chip comprising a substance matrix, the substance matrix comprising at least one of glass or synthetic material.

2. The glove according to claim 1, wherein the glove comprises a welt which is a rolled up section of the end portion, and the identification means being fixedly embedded into the welt.

3. The glove according to claim 2, wherein the identification means is fixedly arranged in a cavity of the welt which is formed between welt turns.

4. The glove according to claim 2, wherein the identification means is connected to the glove so that the identification means is arranged in the welt before a vulcanization process, and the glove is vulcanized with the identification means.

5. The glove according to claim 1, wherein the identification means is fixedly connectable to the glove by vulcanization.

6. The glove according to claim 1, wherein the glove is a multilayer structure of a same material or of different materials, the identification means arranged between two layers at the end portion, and the layers of the glove being fixedly connectable to each other by vulcanization, so that the identification means is fixedly held within the end portion.

7. The glove according to claim 2, wherein the glove together with the identification means at the end portion or the welt arranged on a clamping fixture of a glovebox are mountable to at least one of the welt or the end portion.

8. A system comprising the glove according to claim 1, and comprising at least one of a glovebox, a base station or a transceiver unit.

9. A method for manufacturing a glove, the method comprising:

arranging an identification means on an end portion of a non-vulcanized glove, the identification means embedded in at least one of a welt or between layers of the glove, the identification means being a radio frequency identification (RFID) chip comprising a substance matrix, the substance matrix comprising at least one of glass or synthetic material; and performing a vulcanization of the glove.

10. The method of claim 9, further comprising providing an identification means which is suitable for storing data and for at least one of wirelessly receiving or wirelessly transmitting the data during an entire usage period of the glove.

11. A glove of a glovebox type, the glove comprising:

an identification means arranged at an end portion of a cuff of the glove, the glove comprising a welt that is a rolled up section of the end portion, and the identification means being fixedly embedded into the welt.

12. The glove according to claim 11, wherein the identification means is fixedly arranged in a cavity of the welt, the cavity is formed between welt turns.

13. The glove according to claim 11, wherein the identification means is connected to the glove so that the identification means is arranged in the welt before a vulcanization process, and the glove is vulcanized with the identification means.

14. The glove according to claim 11, wherein the glove together with the identification means at the end portion or the welt arranged on a clamping fixture of a glovebox are mountable to at least one of the welt or the end portion.

15. The glove according to claim 11, wherein the identification means is fixedly connectable to the glove by vulcanization.

16. A system comprising the glove according to claim 11, and comprising at least one of a glovebox, a base station or a transceiver unit.

17. The glove according to claim 11, wherein the identification means is suitable for storing data and for at least one of wirelessly receiving or wirelessly transmitting the data during an entire usage period of the glove.

* * * * *